United States Patent [19]

Sanford

[11] 4,201,656

[45] May 6, 1980

[54] PROCESS AID ADDITION IN HOT WATER PROCESS BASED ON FEED FINES CONTENT

[75] Inventor: Emerson Sanford, Edmonton, Canada

[73] Assignees: Petro-Canada Exploration Inc., Calgary; Her Majesty the Queen in right of the Province of Alberta, Government of the Province of Alberta, Department of Energy and Natural Resources, Alberta Syncrude Equity, Edmonton; Ontario Energy Corporation; Imperial Oil Limited, both of Toronto; Canada-Cities Service, Ltd., Calgary; Gulf Oil Canada Limited, Toronto, all of Canada

[21] Appl. No.: 13,004

[22] Filed: Feb. 21, 1979

[51] Int. Cl.[2] ..... C10G 1/04

[52] U.S. Cl. ..... 208/11 LE; 208/DIG. 1

[58] Field of Search ..... 208/11 LE

[56] References Cited

U.S. PATENT DOCUMENTS

| | | | |
|---|---|---|---|
| 3,401,110 | 9/1968 | Floyd et al. | 208/11 LE |
| 4,105,537 | 8/1978 | McZuitty | 208/11 LE |
| 4,107,029 | 8/1978 | Lorenz | 208/11 LE |

*Primary Examiner*—Herbert Levine

*Attorney, Agent, or Firm*—Ernest Peter Johnson

[57] ABSTRACT

To optimize recovery by the hot water process of hydrocarbons from bituminous sands, an alkaline process aid (e.g. NaOH) is commonly added to the conditioning step. In accordance with this invention, the quantity of process aid added is varied in response to the fines content of the incoming bituminous sands feed.

2 Claims, 6 Drawing Figures

○ BATCH EXTRACTION UNIT (B.E.U.)
△ CONTINUOUS EXTRACTION UNIT (C.E.U.)
MAXIMUM BITUMEN RECOVERY, PRIMARY FROTH (%)
90
80
70
60
7.5
8.0
8.5
9.0
9.5
10.0
10.5
pH AT MAXIMUM RECOVERY

PROCESS AID ADDITION IN HOT WATER PROCESS BASED ON FEED FINES CONTENT

BACKGROUND OF THE INVENTION (a) Field of the Invention

This invention relates to an improvement of the conditioning step of the hot water process for extracting hydrocarbons or bitumen from bituminous sands (commonly and hereafter referred to as 'tar sands'). More particularly, it relates to a technique for controlling the addition of process aid to the conditioning operation with a view to minimizing aid consumption while maximizing bitumen recovery.

(b) Description of the Prior Art

Upgraded hydrocarbons are commercially recovered from tar sands by a three part process involving: (1) mining the whole tar sand; (2) extracting the bitumen from the whole tar sand using the hot water process; and (3) upgrading the recovered bitumen to useful product form. This overall operation is amply described in the patent and other technological literature.

In the first step of the hot water process, the as mined tar sand is 'conditioned'. This involves mixing it with hot water, limited quantities of steam to provide temperature control, and one or more chemical 'process aids' such as sodium hydroxide or sodium silicate. The conditioning operation is carried out in a large rotating horizontal cylindrical tumbler. The retention time of the mixture in the tumbler is something less than 10 minutes. The conditioning step effects a preliminary separation of the three main components of tar sand (i.e. solids, water and bitumen) one from the other.

The product of the conditioning step is a porridge-like slurry. This slurry is screened, to remove oversize rejects, and then diluted with additional hot water. The screened diluted slurry is introduced into a thickener-like vessel commonly called a primary separation vessel (PSV). Here, the bulk of the bitumen floats to the surface of the vessel contents and forms primary bitumen froth, which is recovered. A solids-rich primary tailings stream is withdrawn from the base of the primary separation vessel and pumped to waste disposal. To gain a further yield of bitumen, a stream of middlings is withdrawn from the midsection of the primary separation vessel. These middlings are treated in subaerated flotation cells to produce a secondary bitumen froth and a secondary tailings stream (which also goes to waste disposal). The froths are subsequently combined, contained water and solids are removed, and the clean bitumen is subjected to upgrading.

As previously stated, the present invention is concerned with the rate of addition of the process aid(s) to the conditioning step. The purpose of the process aid(s) is to assist in separating the bitumen from the mineral matter in the conditioning step. It has been commonly stated in the prior art that the quantity of process aid is determined by controlling the pH of the middlings in the primary separation vessel to a narrow range. For example, Canadian Pat. No. 841,581 to Floyd et al recommends adding process aid so as to obtain a middlings pH range of 7.5 to 9.0, preferably 8.0 to 8.5.

A method of anticipating pH changes due to the buffering action of clays present in tar sand has been described in Canadian Pat. No. 922,254, issued to White and Loveland. These workers measured the aluminum content of the tar sand and related that to the clay content and thereafter practised maintaining a constant middlings pH by regulating water and sodium hydroxide addition according to clay content. This method again results in limiting primary separation vessel middlings pH to a narrow range. Working along similar lines, Graybill and White (Canadian Pat. No. 889,823) measure middlings density to control water addition. Addition of a constant dosage of process aid based on tar sand feed has also been used in an attempt to keep middlings pH constant.

SUMMARY OF THE INVENTION

As a result of testing various types of tar sand feeds in a hot water process test circuit, I have noted that each tar sand will yield a maximum bitumen recovery at a particular pH condition in the conditioning step, all other factors being kept constant. These pH values for various tar sands vary relatively widely. This is illustrated in FIG. 1, wherein maximum recovery and the corresponding pH are plotted for a number of tar sands, each tar sand having been tested over a range of pH's. As can be seen, for those tar sands tested, the pH at maximum recovery ranges from about 7.7 to about 10.4.

Thus the prior art approach of monitoring pH and seeking to maintain it within a relatively narrow range is, in my view, erroneous. Instead, I propose that, as the tar sand feed composition varies, the amount of process aid added in the conditioning step be also varied to yield substantially the maximum bitumen recovery possible for that particular tar sand.

The issue then becomes what parameter(s) can be used to determine the desired quantities or rate of addition of process aid(s) to the conditioning step. I have found that there is a correlation between the fines content of a particular tar sand feed and the rate of process aid addition which should be added to the conditioning step of the particular hot water process plant involved so as to maximize bitumen recovery from that tar sand. ("Fines" are those solids in the tar sand capable of passing through a -325 mesh screen.)

In its broadest aspect, therefore, the invention involves establishing measurements indicative of the varying fines content in the incoming tar sand feed and adding the process aid to the conditioning step in response to such measurements so as to substantially maximize bitumen recovery from the process while substantially minimizing process aid consumption.

In order to obtain these measurements rapidly and accurately, I prefer to monitor a downstream parameter, such as the middlings density, which is indicative of the fines content of the tar sand feed. In doing so, it is appreciated that there is about a 30 minute time lag between the time feed enters the process and the moment when that feed is passing the measurement point. However, the tar sand composition does not normally change sufficiently over such a time period to make the measurement significantly incorrect.

DETAILED DESCRIPTION OF THE INVENTION

In the first step of the process, measurements are established or taken which provide an indication of the fines content in the incoming tar sand feed. This may be done in a variety of ways. One could directly measure the fines content in the whole tar sand. However this involves cleaning the bitumen from the solids to provide a sample for particle size distribution analysis—this is too lengthy a process to use for good control over the process aid addition. It is preferred to measure fines or fines—related properties in downstream streams of the hot water process.

For example, the level of fines in middlings may continuously and rapidly be measured by a microtrac particle size monitor such as that marketed by Leeds and Northrup Co., North Wales, Pa. Alternatively, a sample of middlings may be settled (e.g. for one minute) and the density of the resulting aqueous phase may then be measured. Still another alternative is to use the microtrac particle size monitor to measure the fines content in settled secondary tailings.

Figure 5:
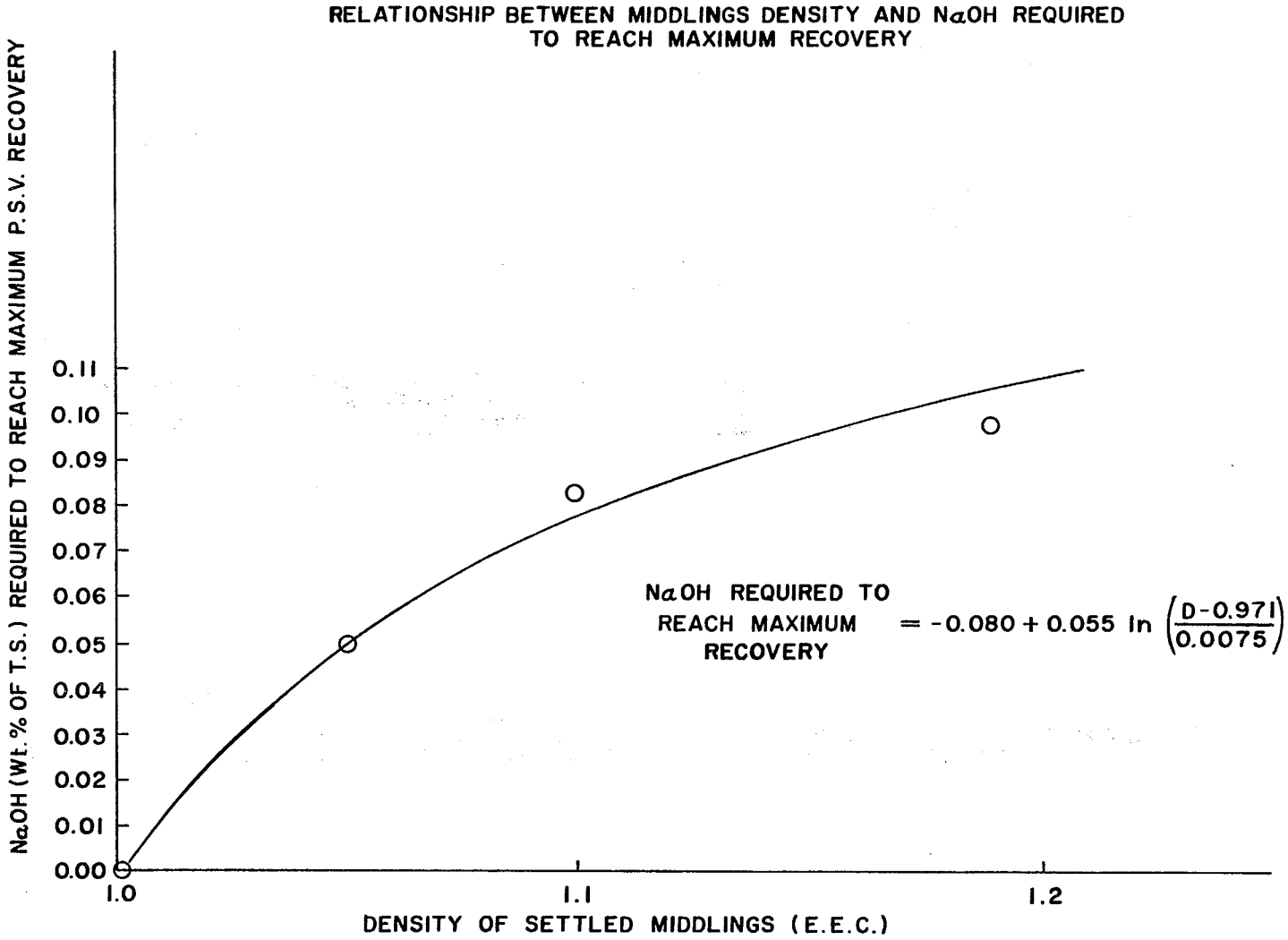
FIG. 5 is a plot of density of settled middlings versus NaOH required to obtain maximum recovery.

Any of these measurements is indicative of the fines content in the tar sand feed. The measurements are then used as the basis on which to add the process aid to the conditioning step. Before doing so, the processing plant involved must be calibrated to establish the quantitative relationship between the fines content measurement and the quantity of process aid required. To calibrate the plant, in the case of using middlings density as the control, the process is operated at a known level of process aid addition and samples are taken and analysed to give the bitumen content in the primary froth and the middlings density. The process is allowed to operate at the same process aid addition rate and, as the quality of feed varies, data for actual bitumen recovery and middlings density are collected. Process aid levels are then raised and lowered to new known values, each being maintained while variations in tar sand quality occur. The level of process aid addition required to achieve maximum recovery may then be plotted for each value of middlings density and the resulting curve used in thereafter controlling process aid addition to the tumbler. An example is shown in FIG. 5. Alternatively the mathematical expression that defines the relationship between middlings density and level of process aid required for maximum recovery may be computed. Such expressions take the form $y=a+b\ 1n\ x$ where y=level of process aid required for maximum recovery x=level of fines in tar sand or some stream quality correlatable therewith. Typical stream qualities of which middlings density is an example, are listed herein.

a and b are coefficients peculiar to each extraction unit.

Such expressions are appropriate for modern processing plants where process control is by on-line computer. With a and b as constants, the computer may be programmed to continuously supply values of y responsive to data of the type x. Furthermore, output y may be linked to controlling means to automatically vary the process aid addition rate responsive to x.

Figure 1:
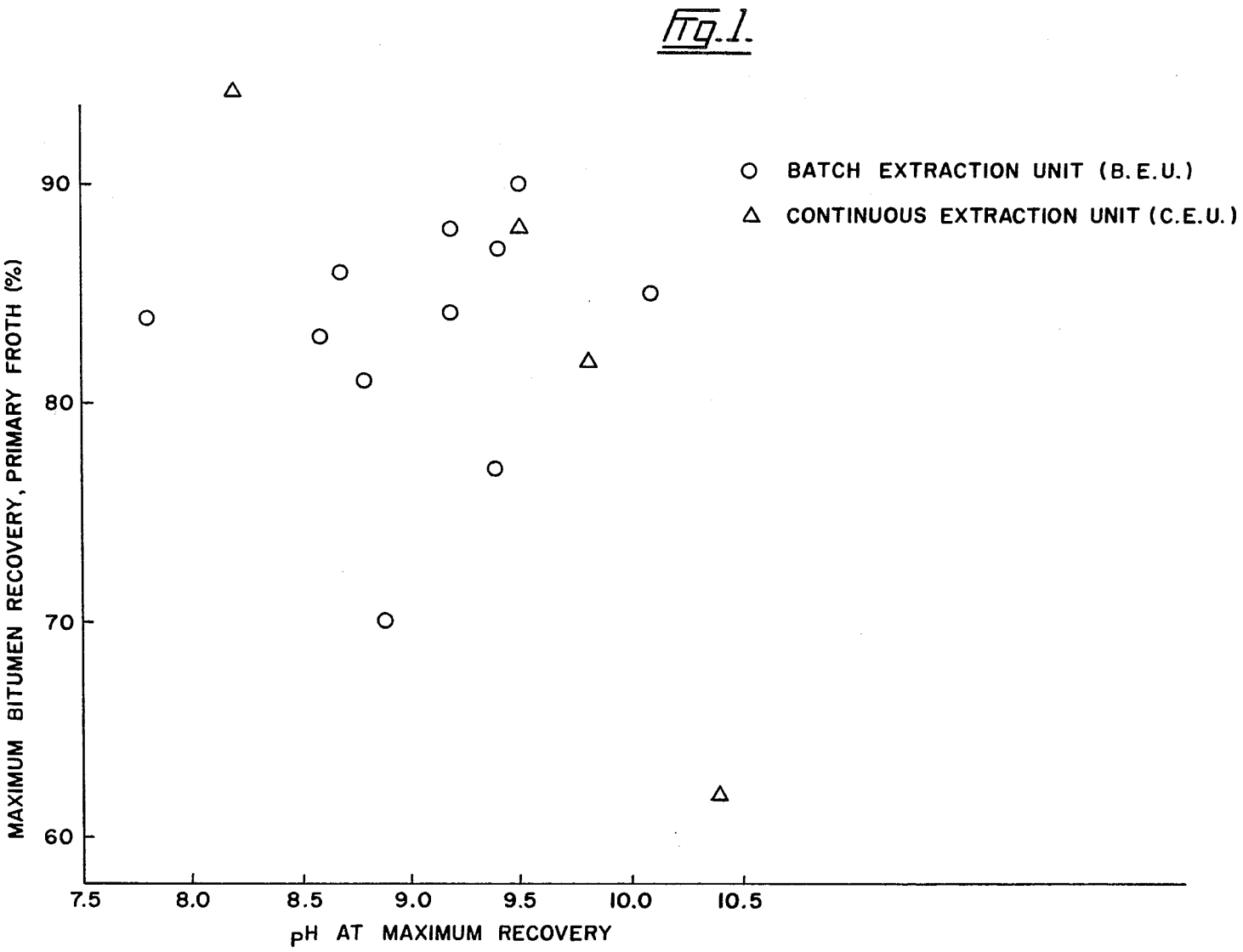
FIG. 1 is a plot of maximum bitumen recovery (in primary froth) versus pH of the aqueous phase of diluted slurry from which the respective primary froths were obtained.
Figure 2:
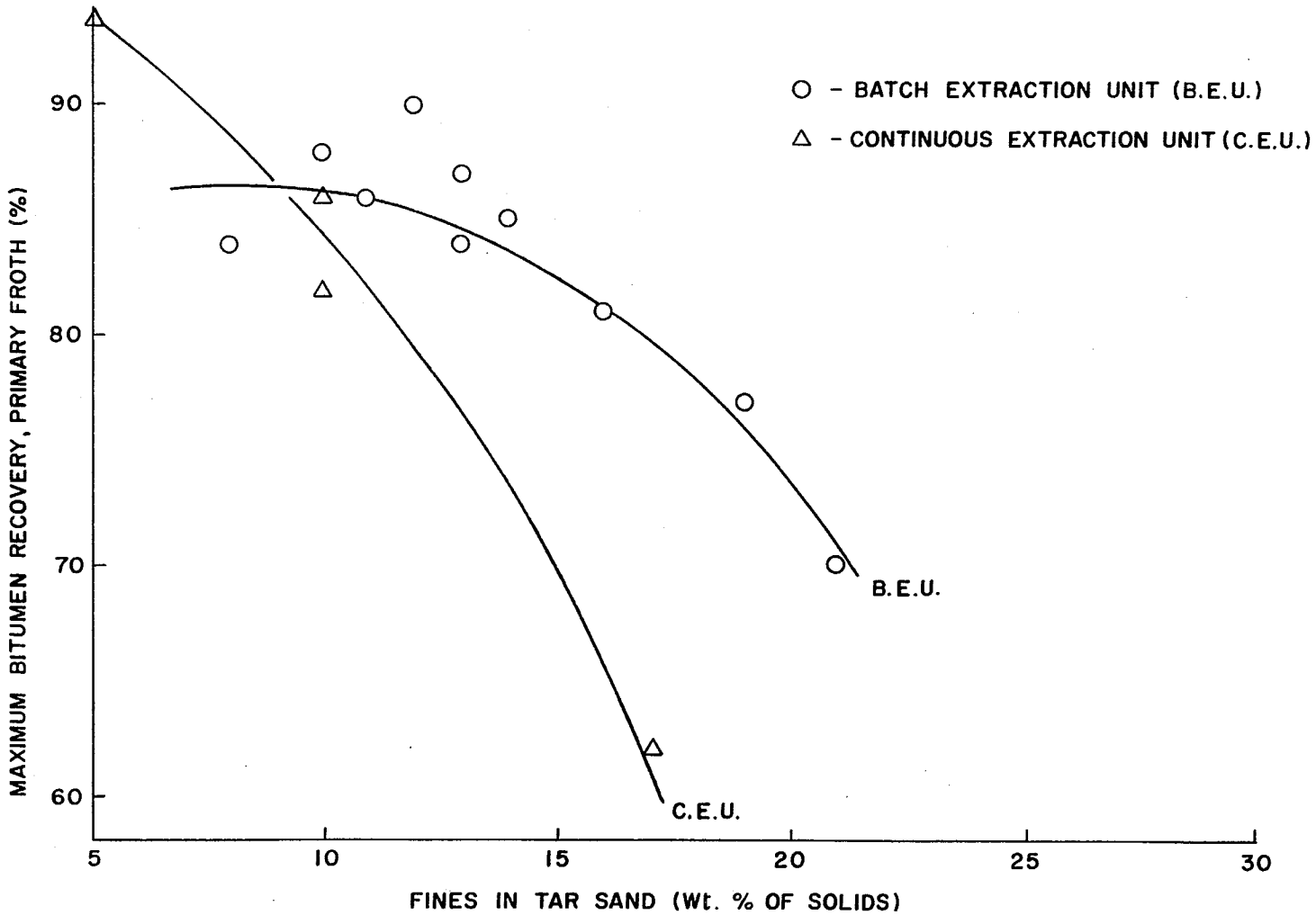
FIG. 2 is a plot of maximum bitumen recovery (in primary froth) versus fines in tar sand feed. Two curves are shown, for two different extraction units.
Figure 3:
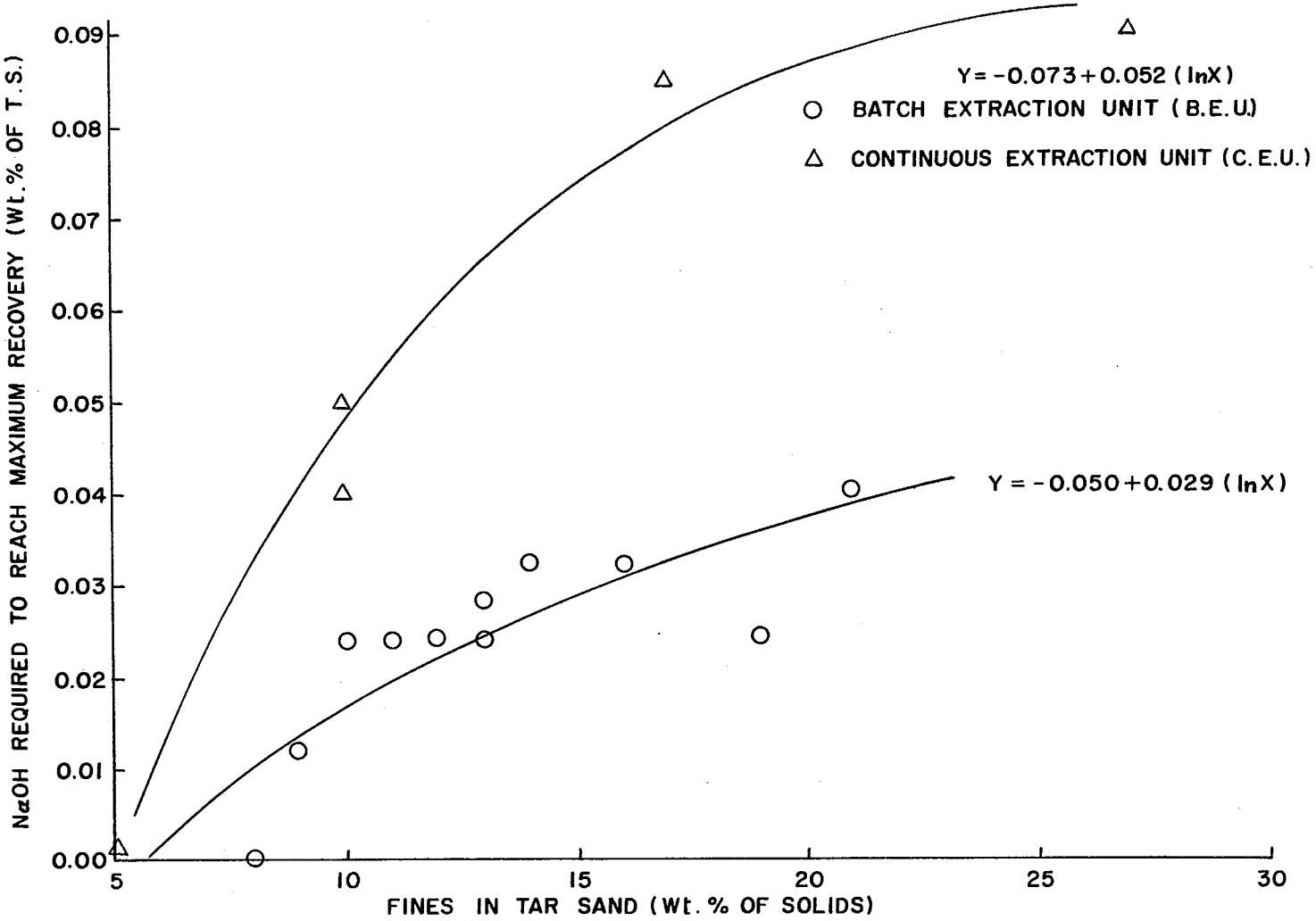
FIG. 3 is a plot of sodium hydroxide needed for maximum recovery as a function of fines in tar sand.
Figure 4:
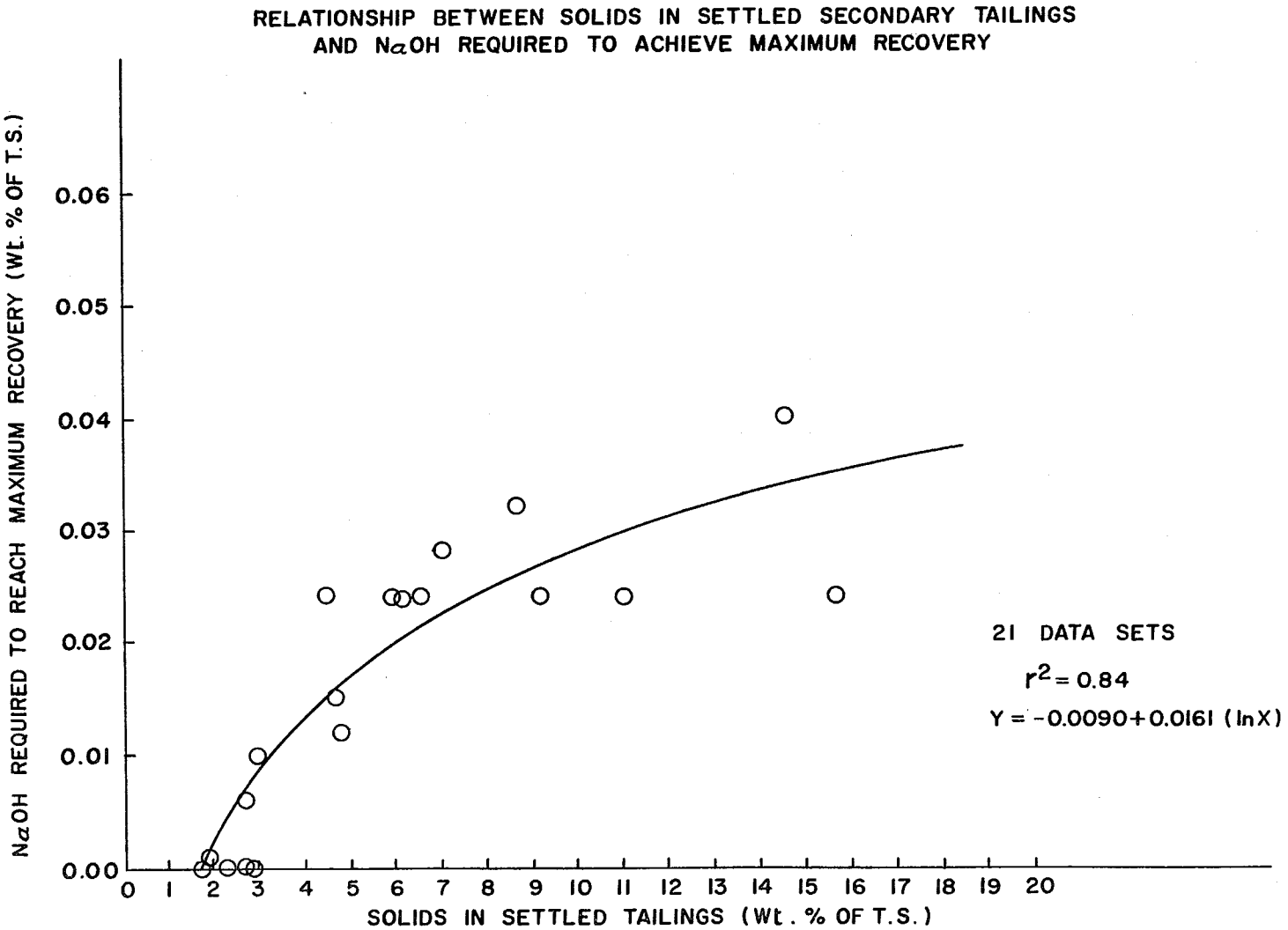
FIG. 4 is a plot of solids in settled tailings versus NaOH required to obtain maximum recovery.
Figure 6:
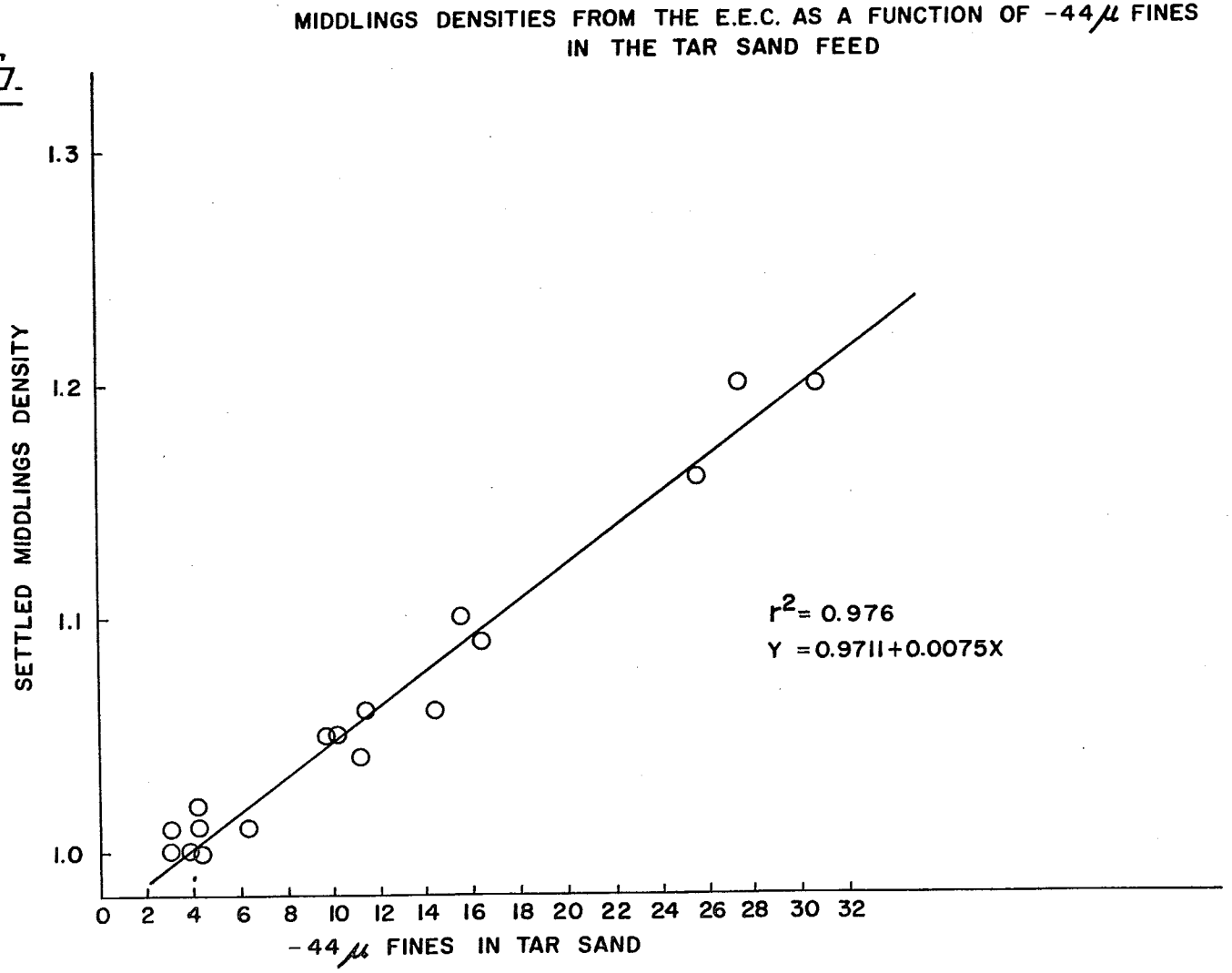
FIG. 6 is a plot of fines in tar sand obtained by particle size distribution analysis against settled middlings density for the same tar sands.

Turning now to a consideration of the figures, FIG. 1 shows that maximum recoveries for tar sands of varying compositions do not fall within a narrow pH range. FIG. 2 shows that when one tests a series of tar sands having different fines content, it is found that recoveries decrease as fines contents increase. FIG. 3 shows the type of curve which would be developed for a plant in order to practice the invention. This is the quantitive relationship previously referred to. The curve shows that, for a particular plant, the amount of process aid required for maximum bitumen recovery increases as the fines level in the feed increases. FIG. 4 shows that the level of solids in the aqueous phase of secondary tailings after settling for 1 minute is related to the quantity of sodium hydroxide needed to give maximum recovery. FIG. 5 shows that the density of settled middlings is related to the quantity of sodium hydroxide needed to give maximum recovery. FIG. 6 shows the relationship between fines in tar sand and settled middlings density.

The invention is characterized by several advantages. A first advantage is that the recovery of bitumen from tar sand may be enhanced by practising optimum addition of process aid. Adding process aids to give constant pH or constant dosage only occasionally adds the optimum quantity of process aid for a certain tar sand feed. For high fines tar sand, larger quantities of process aid are needed than are called for when operating at pH of about 8 to 9 whereas for low fines tar sand, smaller quantities are called for than would be used to achieve this pH range. A second advantage is in a savings of process aid(s). Such chemical substances as sodium hydroxide must be purchased, and then transported a considerable distance to the tar sand area, and efficient use leads to a valuable savings. A third advantage is in the improved control over the hot water process. Improper dosages of process aids may be responsible for substantial loss of bitumen from the circuit, mainly as losses to primary and secondary tailings. Furthermore, excessive use of process aids may lead to water-in-oil emulsions during later froth pumping which in turn can cause problems in froth treatment. The hot water process is notoriously sensitive to the quality of the tar sand feed. The instant invention establishes fines in tar sand feed as the source of sensitivity, and reveals how the quantity of process aid may be made responsive to the fines content in the feed to better bring the process under control.

The embodiments of the invention in which an exclusive property or privilege is claimed are defined as follows:

1. In the hot water process for recovering bitumen from tar sands feed of varying composition containing varying contents of fines wherein said feed is conditioned with hot water and a process aid, the improvement comprising:

establishing measurements indicative of the varying fines content of the tar sands feed; and adding the process aid to the conditioning step in quantities responsive to the quantities of fines present in the feed so as to substantially maximize bitumen recovery from the process while substantially minimizing process aid consumption.

2. In the hot water process for recovering bitumen from tar sands feed containing fines wherein said feed is first conditioned with hot water and a process aid to produce a slurry, the slurry is then diluted with hot water and retained in a primary separation vessel to produce middlings, and the middlings are treated in a subaerated flotation cell to produce secondary tailings, the improvement comprising:

settling samples of middlings;

establishing measurements indicative of the densities of the settled middlings samples;

adding the process aid to the conditioning step in quantities responsive to the measurements and thus to the quantities of fines present in the feed so as to substantially maximize bitumen recovery from the process while substantially minimizing process aid consumption.

* * * * *